US011363370B2

(12) United States Patent
Ji et al.

(10) Patent No.: US 11,363,370 B2
(45) Date of Patent: Jun. 14, 2022

(54) RECEIVER MODULE INTEGRATED WITH DUCT

(71) Applicant: EM-TECH Co., Ltd., Gyeongsangnam-do (KR)

(72) Inventors: Yong Ju Ji, Gyeongsangnam-do (KR); Jun Hee Han, Gyeongsangnam-do (KR); Young Seok Noh, Gyeongsangnam-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 17/083,942

(22) Filed: Oct. 29, 2020

(65) Prior Publication Data

US 2021/0136484 A1 May 6, 2021

(30) Foreign Application Priority Data

Nov. 1, 2019 (KR) ..... 10-2019-0138585
Nov. 19, 2019 (KR) ..... 10-2019-0148597

(51) Int. Cl.
*H04R 1/28* (2006.01)
*H04R 1/10* (2006.01)

(52) U.S. Cl.
CPC ..... *H04R 1/2819* (2013.01); *H04R 1/1016* (2013.01); *H04R 1/2826* (2013.01)

(58) Field of Classification Search
CPC .. H04R 1/2819; H04R 1/1016; H04R 1/2826; H04R 1/1091; H04R 9/02; H04R 2201/10; H04R 1/10; H04R 1/2823; H04R 1/2846; H04R 7/04; H04R 2460/11
See application file for complete search history.

(56) References Cited

U.S. PATENT DOCUMENTS 4,742,887 A 5/1988 Yamagishi
10,631,080 B2 * 4/2020 Lee ..... H04R 1/2826

FOREIGN PATENT DOCUMENTS

JP 4150611 B2 * 9/2008
KR 100694160 B1 3/2007
KR 101423841 B1 8/2014
KR 101558091 B1 10/2015
KR 101956884 B1 3/2019

* cited by examiner

*Primary Examiner* — Brian Ensey
(74) *Attorney, Agent, or Firm* — Murphy, Bilak & Homiller, PLLC

(57) ABSTRACT

Disclosed is a receiver module integrated with a duct. The present disclosure provides a receiver module integrated with a duct in which a back volume and a duct are provided at an outer circumference of a frame of a receiver.

14 Claims, 12 Drawing Sheets

RECEIVER MODULE INTEGRATED WITH DUCT

TECHNICAL FIELD

The present disclosure relates to a receiver module integrated with a duct.

BACKGROUND

Earphones are classified into a closed air type and an opened air type according to shapes of housings in which a sound conversion device is embedded. The closed air type refers to an earphone in which the housing is sealed from the outside, and open air type refers to an earphone in which a small hole (called a back hole) is provided at an edge of a rear of the housing so that inside of the housing communicates with an outside.

In the case of the closed type, since sound pressure inside the ear varies according to an insertion state of the earphone, sound quality during listening may vary depending on the insertion state of the earphone. Meanwhile, in the case of the open-type earphone, since the inside of the housing communicates with the outside, sound pressure inside the ear may be kept constant from low to high registers. Meanwhile, in the opened air type earphone, external sound is prevented from being mixed by installing a ventilation resistor using a urethane foam or the like in the back hole installed at the housing.

Meanwhile, in the opened air type earphone, resonance occurs between the middle and high registers of an acoustic signal according to a size of the back hole, which causes a peak of sound pressure between the middle and high registers to deteriorate frequency characteristics of the earphone. In order to solve this problem, an opened air type earphone having a duct has been developed. The opened air type earphone having such a duct is disclosed in U.S. Patent Laid-Open Publication No. 4,742,887.

However, in the case of forming a duct, the housing of the earphone should have an elongated portion in addition to an ear bud inserted into the ear, leading to drawbacks in terms of design, and an overall size of the earphone increases because a duct space should be included.

In order to improve such drawbacks, an opened air type earphone having a bracket capable of forming a duct at a rear space of the earphone has been proposed by the applicant.

FIG. 1 is a projection view showing installation of a bracket of an opened air type earphone with a bracket for forming a duct according to the related art as viewed from a rear housing, FIG. 2 is a cross-sectional view of an opened air type earphone provided with a bracket for forming a duct according to the related art, and FIG. 3 is a projection view of the opened air type earphone having a bracket for forming a duct according to the related art as viewed from the inside of the bracket.

The opened air type earphone having a bracket for forming a duct according to an embodiment of the present disclosure includes housings 10 and 20 having a shape that can be inserted into an ear canal. The housings 10 and 20 include a front housing 10 facing the user's ear and having sound emitting holes 12 and 14 for emitting sound and a rear housing 20 facing an exterior and having a back hole 20*a* through which air flows.

A receiver 30 is installed in the housings 10 and 20, and in the case of a wireless earphone capable of performing wireless communication, electronic equipment such as a control board (not shown), a Bluetooth module (not shown), and a battery (not shown) may be further provided.

The receiver 30 is installed such that a surface that emits sound, that is, a surface on which the diaphragm is located, faces the front housing 10.

A bracket 40 is installed between the rear housing 20 and the receiver 30. The rear housing 20 includes a back hole 20*a* through which the inside of the housing communicates with the outside so as to maintain a constant sound pressure inside the ear. The rear bracket 40 is coupled to an inner surface of the rear housing 20 to form a back volume 21 and a duct 42. That is, the back volume 21 and the duct 42 at the rear of the receiver 30 are distinguished by the rear bracket 40. The rear bracket 40 covers a part of the back hole 20*a*, and a back volume communication hole 41 communicating with the back volume 21 and a duct communication hole 44 communicating with the duct 42 are connected to the back hole 20*a*.

As such, in order to tune sound characteristics smoothly, flow of air around the receiver and a change in pressure of the air should be adjusted, and accordingly, the duct 42 (air flow passage) at the rear space of the receiver is constructed. Depending on the size and volume of the duct, sound pressure fluctuates in a low range (3 kHz or less), and tuning in the low range allows for a richer low range hearing. However, in the case of providing the duct at the rear space of the receiver in a true wireless stereo (TWS), which is a current wireless earphone module, since a PCB or its related hardware components are arranged on a rear surface to implement a wireless earphone at the rear, there is a restriction in space of the duct that can be secured by the bracket 40, and the space occupied by the rear bracket 40 inevitably increases a volume of the overall earphone when installed.

In addition, a length and a volume of the duct 42 are flexible according to volume variations of hardware equipment (parts), having a disadvantage in that characteristic variations of the receiver for each design occur.

Accordingly, there is a need to develop a structure capable of tuning sound by providing a duct without increasing the volume of the rear surface.

SUMMARY

Therefore, an object of the present disclosure is to provide a receiver capable of tuning sound by providing a duct without increasing a volume of a rear surface.

According to an aspect of the present disclosure, there is provided a receiver module integrated with a duct, including: a receiver including a magnetic circuit, a frame covering the magnetic circuit, a voice coil, and a diaphragm and having a back hole for ventilation on the frame; a back volume communicating with the back hole of the receiver and an outside and amplifying sound through resonance; and a duct provided in the back volume and having a communication hole communicating with the outside separately from the back volume, wherein the back volume is disposed on an outer circumference of the receiver.

In addition, as another example of the present disclosure, the back volume may have a size not exceeding an overall height of the receiver.

In addition, as another example of the present disclosure, the back volume may be defined by an air module body coupled to an outer circumference of the frame, the frame, and a plate attached to a lower surface of the air module body.

In addition, as another example of the present disclosure, the air module body may include a partition forming a duct.

In addition, as another example of the present disclosure, the receiver module integrated with a duct may further include: an air module body having a lower surface coupled to an inner circumference of the frame and a side surface coupled to an outer circumference of the frame and defining a back volume with the frame; and a duct body coupled within the air module body and defining the duct.

In addition, as another example of the present disclosure, the lower surface of the air module body may include a back volume communication hole communicating with the back volume and a duct communication hole communicating with the duct.

According to another aspect of the present disclosure, there is provided a receiver module integrated with a duct, including: a receiver including a magnetic circuit, a frame covering the magnetic circuit, a voice coil, and a diaphragm, and having a back hole provided at the frame for ventilation; a back volume communicating with the back hole of the receiver and an outside and amplifying sound through resonance; and a duct provided in the back volume and having a communication hole communicating with an outside separately from the back volume, wherein the back volume is provided in the frame.

In addition, as another example of the present disclosure, the frame of the receiver may have an inner wall coupled to a yoke, an outer wall formed to be spaced apart from the inner wall, and a duct forming partition traversing the inner wall and the outer wall, and the receiver module integrated with a duct may further include: a plate coupled to the inner wall and the outer wall of the frame and having a back volume communication hole and a duct communication hole.

In addition, as another example of the present disclosure, the back volume may have a size not exceeding an overall height of the receiver.

According to another aspect of the present disclosure, there is provided a receiver module integrated with a duct, including: a receiver including a magnetic circuit, a frame covering the magnetic circuit, a voice coil, and a diaphragm, and having a back hole provided at the frame for ventilation; a back volume communicating with the back hole of the receiver and an outside and amplifying sound through resonance; and a duct provided in the back volume and having a communication hole communicating with an outside separately from the back volume, wherein the back volume is disposed within an overall height of the receiver.

The receiver module integrated with a duct provided by the present disclosure includes a duct formed around the receiver without a rear structure, and thus has uniform characteristics regardless of rear hardware space volume variation and is excellent in mass production.

Since the duct is integrally modularized with the receiver, the duct may be installed at the same height as the back hole of the receiver, whereby a rear of the duct may be utilized as a space for mounting a component, enabling a more compact device design.

DETAILED DESCRIPTION

Figure 1:
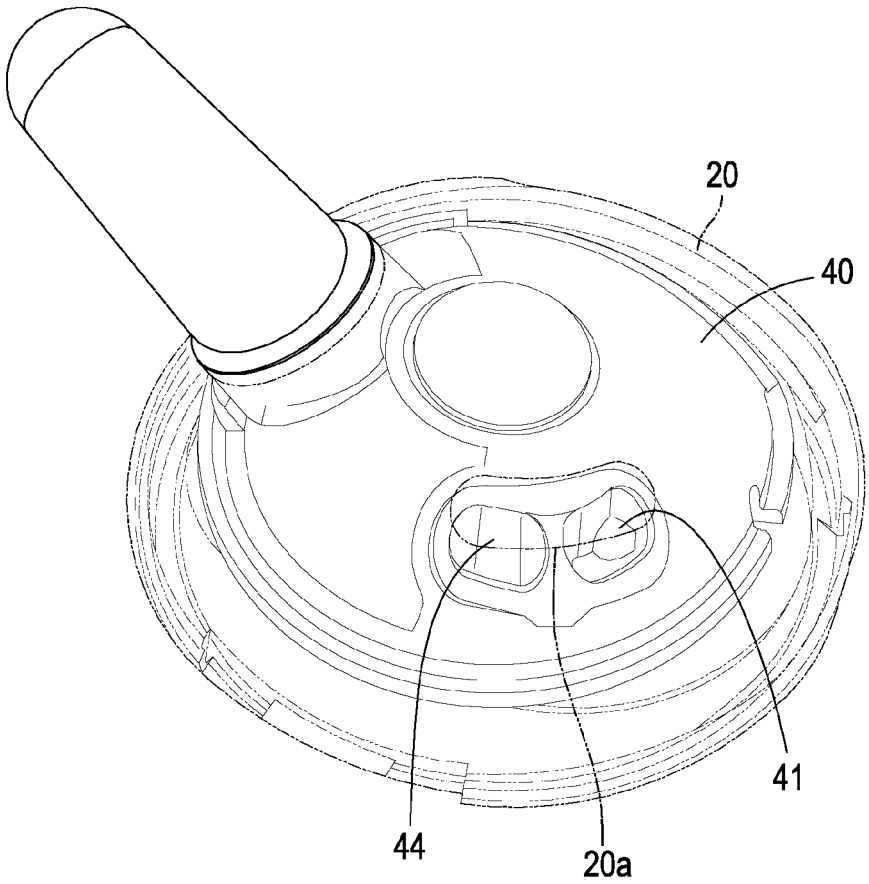
FIGURE 1 (PRIOR ART)
FIG. 1 is a perspective view of a bracket installation of an opened air type earphone having a bracket for forming a duct according to the related art as viewed from a rear housing.
Figure 2:
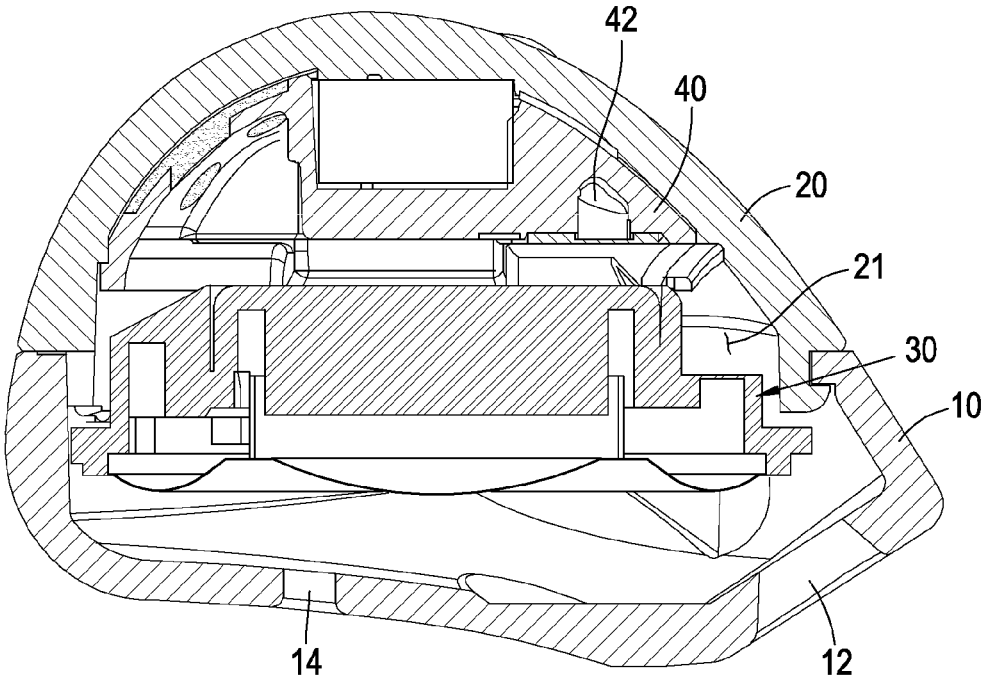
FIGURE 2 (PRIOR ART)
FIG. 2 is a cross-sectional view of an opened air type earphone having a bracket for forming a duct according to the related art.
Figure 3:
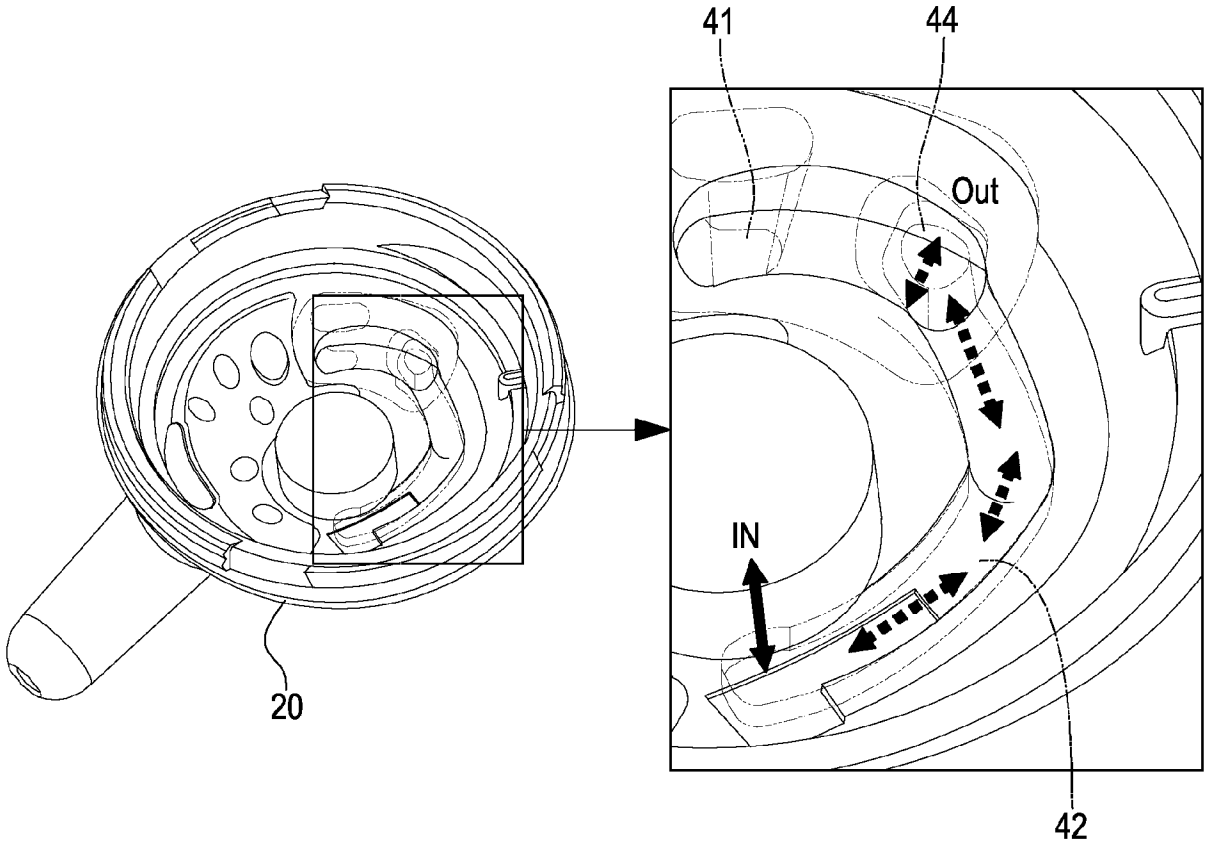
FIGURE 3 (PRIOR ART)
FIG. 3 is a perspective view of an opened air type earphone having a bracket for forming a duct according to the related art as viewed from the inside of the bracket.
Figure 4:
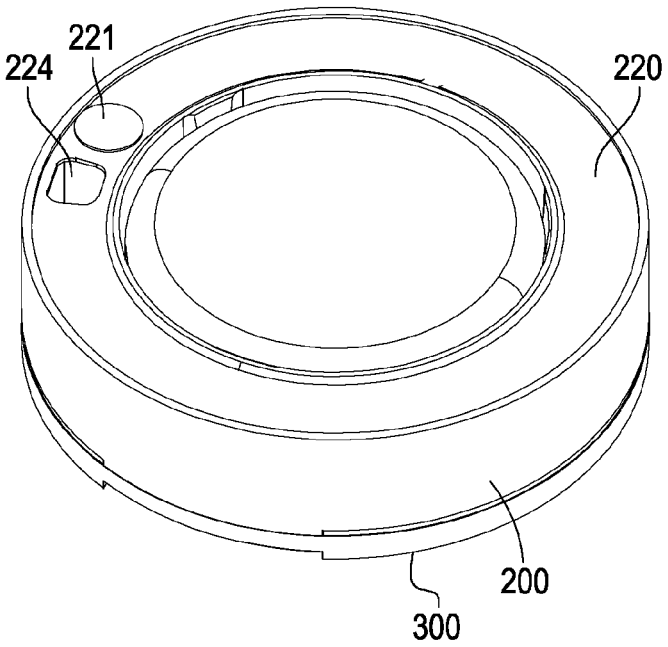
FIG. 4 is a rear view of a receiver module integrated with a duct according to a first embodiment of the present disclosure.
Figure 5:
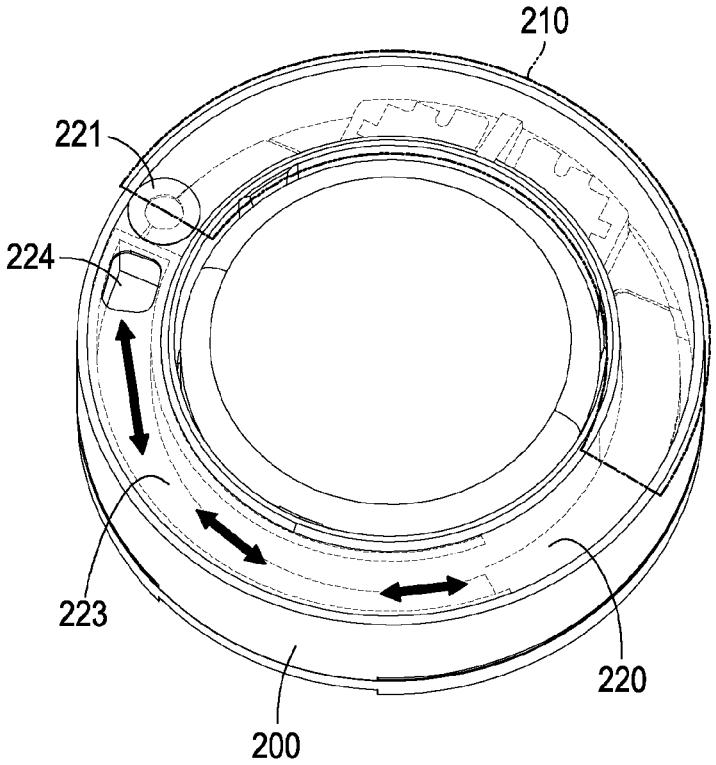
FIG. 5 is a rear perspective view of the receiver module integrated with a duct according to the first embodiment of the present disclosure.
Figure 6:
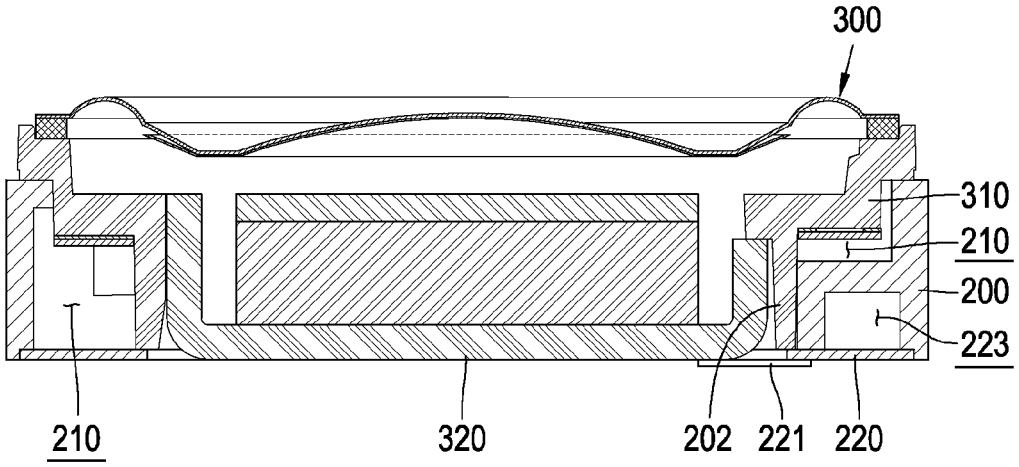
FIG. 6 is a rear view of the receiver module integrated with a duct according to the first embodiment of the present disclosure.

FIG. 4 is a rear view of a receiver module integrated with a duct according to a first embodiment of the present disclosure, FIG. 5 is a rear perspective view of the receiver module integrated with a duct according to the first embodiment of the present disclosure as viewed from the rear side, and FIG. 6 is a rear perspective view of the receiver module integrated with a duct according to the first embodiment.

The receiver module integrated with a duct according to the first embodiment of the present disclosure includes a receiver 300, an air module body 200 coupled to the receiver 300 to form a duct and a back volume, and a plate 220.

The receiver 300 has a general shape and includes a frame 310 having an outer wall, a yoke 320 coupled within the frame 310 and forming a lower surface, a magnet bonded to the yoke 320, a voice coil located in a magnetic gap between the yoke 320 and the magnet, and a diaphragm vibrated by vibration of the voice coil and generating sound. The frame 310 covers a magnetic circuit including the yoke 320 and the magnet, the voice coil and the diaphragm, and has a back hole (not shown) for ventilation on the frame.

The air module body 200 is coupled to an outer wall of the frame 310, surrounds the outer wall of the frame 310, and has an overall height smaller than that of the frame 310. The plate 220 is bonded to a lower surface of the air module body 200 and has a ring shape. An inner circumference of the plate 220 is coupled to the frame 310 and an outer circumference thereof is coupled to the air module body 200.

The air module body 200 includes an "L"-shaped partition 202 at a partial region thereof to partition upper and lower spaces, thereby partitioning a back volume 210 and a duct 223. The back volume 210 communicating with the back hole of the frame of the receiver is formed at a rear of the receiver 300 and serves to amplify sound of the receiver 300. In addition, the duct 223 serves to perform a frequency tuning function to particularly amplify a sound pressure in a low frequency range to flatten sound pressure in the entire frequency range. Here, frequency tuning through the duct 223 may be easily adjusted by changing a length of the partition 202 (i.e., an angle occupied by the partition in 360°).

The plate 220 includes a back volume communication hole 221 communicating with the back volume 210 and a duct communication hole 224 communicating with the duct 223. A mesh or the like may be bonded to the back volume communication hole 221 and the duct communication hole 224 to prevent inflow of foreign matter.

Here, it is preferable that the plate 220 is coplanar with a yoke 320 of the receiver 300. The flat surface of the yoke 320 and the plate 220 may facilitate installation of PCB or its related hardware components for configuring an earphone on a rear surface of the yoke 320 and the plate 220. Preferably, such omission of the bracket of the related art at the rear space may facilitate installation of PCB or its related hardware components for implementing the wireless earphone on the rear space.

Figure 7:
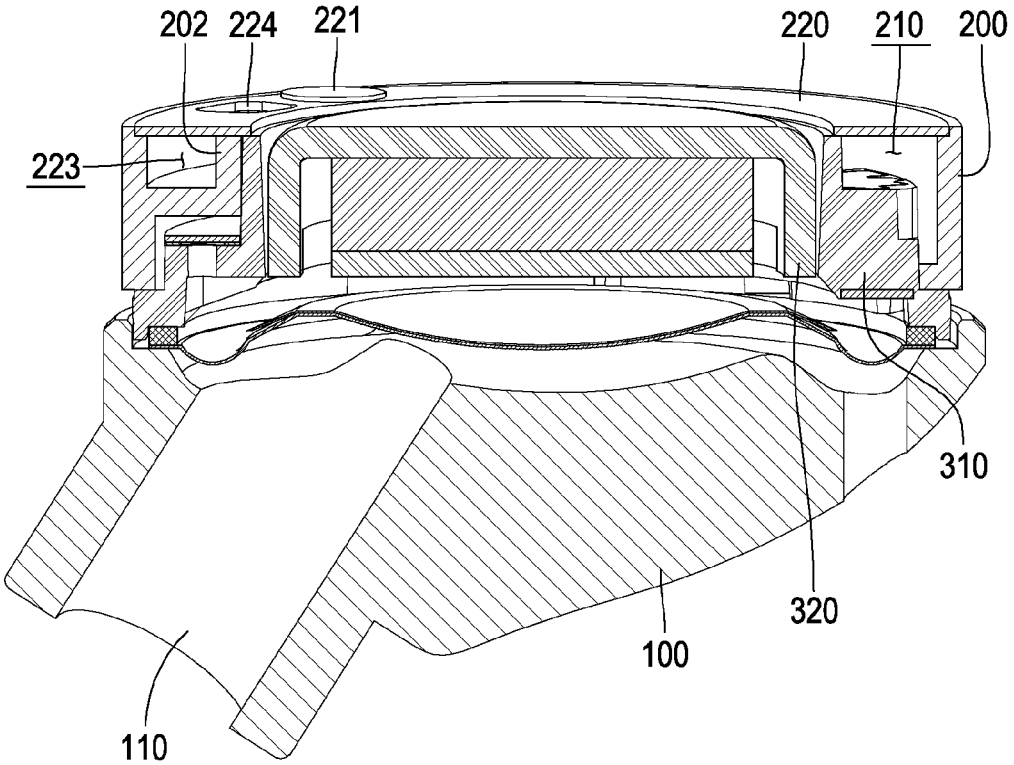
FIG. 7 is a view showing a state in which the receiver module integrated with a duct according to the first embodiment of the present disclosure is coupled with a front housing of an earphone.

FIG. 7 is a view showing a state in which a receiver module integrated with a duct according to the first embodiment of the present disclosure is coupled with a front housing of an earphone.

Sound generated by the receiver 300 is emitted through a sound emitting hole 110 of the front housing 100, and since the receiver 300 itself has the back volume 210 and the duct 223, a design of a rear surface of the earphone may be freely changed. In addition, since the back volume 210 and the duct 223 are included in the receiver module, there is no need to change the structure of the duct 223 and the back volume 210 even if design of a device mounted on the rear surface of the earphone is changed. Therefore, there is an advantage that the structure of the duct 223 may be standardized (modularized) regardless of earphone design.

Meanwhile, in the case of the related art structure, a thickness of the receiver and the duct corresponds to the sum of a thickness of a receiver unit and even a thickness of a bracket. However, in the case of the receiver module integrated with a duct, since the air module body 200 and the plate 220 are installed within a thickness range of the receiver, the thickness of the receiver corresponds to a thickness of the receiver module integrated with a duct. That is, in the present disclosure, the thickness (overall height) may be reduced as much as the thickness of the bracket of the related art. This brings about an effect of reducing a thickness of the rear surface of the earphone on which the receiver module integrated with a duct according to the present disclosure is installed.

Figure 8:
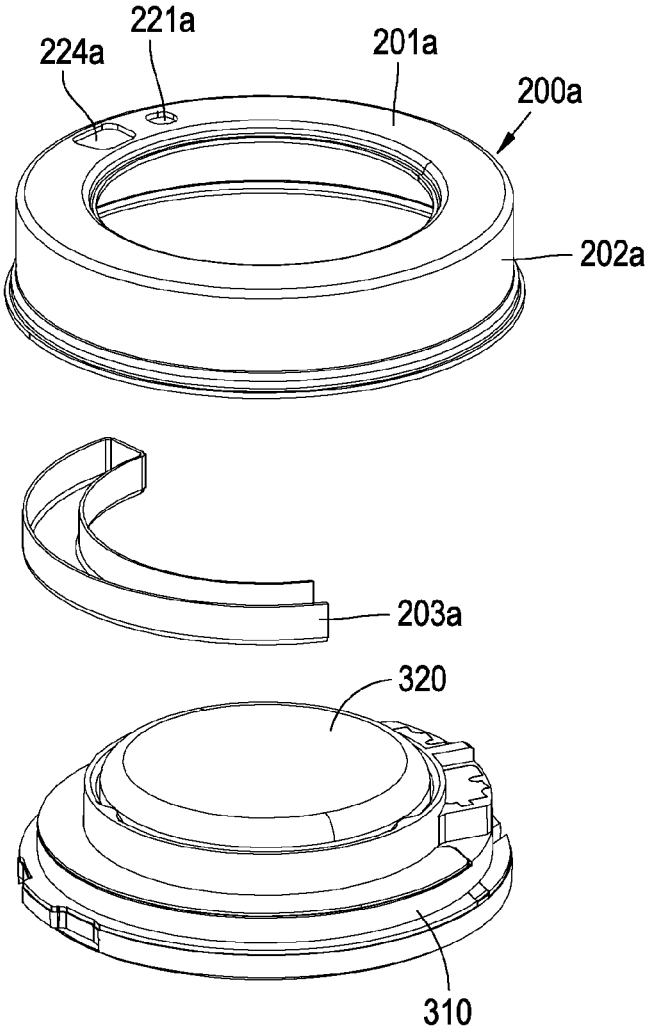
FIG. 8 is an exploded view of a receiver module integrated with a duct according to a second embodiment of the present disclosure.
Figure 9:
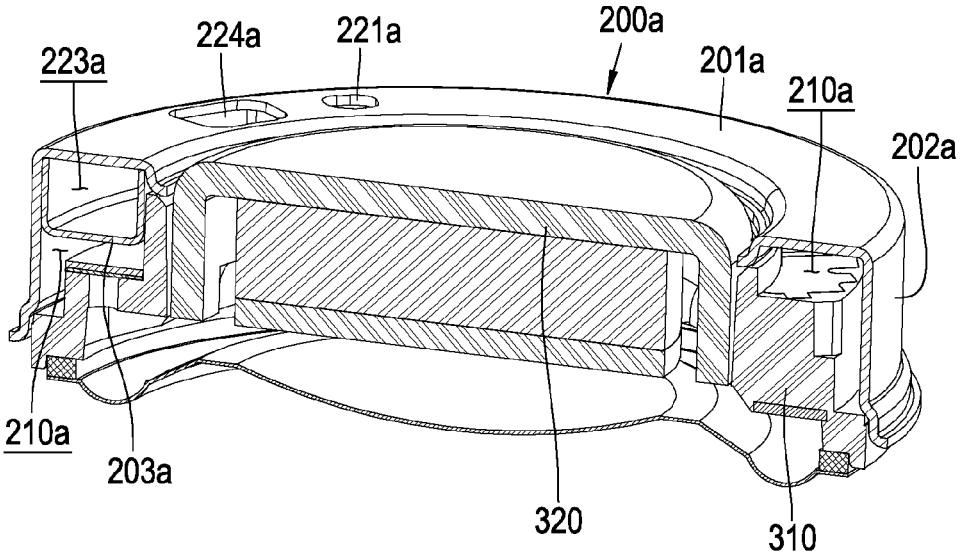
FIG. 9 is a cross-sectional view of a receiver module integrated with a duct according to the second embodiment of the present disclosure.

FIG. 8 is an exploded view of a receiver module integrated with a duct according to a second embodiment of the present disclosure, and FIG. 9 is a cross-sectional view of a receiver module integrated with a duct according to the second embodiment of the present disclosure.

The receiver module integrated with a duct according to the second embodiment of the present disclosure has a lower surface 201*a* coupled to an inner circumference of the frame 310 and a side surface 202*a* coupled to an outer circumference of the frame 310 and includes an air module body 200*a* defining a back volume 210*a* with the frame 310. Here, unlike the first embodiment, a partition defining a duct is not integrally formed in the air module body 200*a*, and a duct body 203*a* defining a duct 230*a* is provided.

In order to be in stably contact with the inner circumference of the frame 310, the lower surface 201*a* may have a bent portion bent upward (downward in the drawing), and the lower surface 201*a* may have a back volume communication hole 221*a* communicating with the back volume 210*a* and a duct communication hole 224*a* formed at a region to which the duct body 203*a* is coupled, as in the first embodiment.

The air module body 200*a* does not cover the yoke 320, and thus the lower surface 201*a* has a ring shape with a central hole. Accordingly, the duct body 203*a* coupled to the air module body 200*a* also has a shape of a part of a ring. A length of the duct 230*a* may be changed by changing a length of the duct body 203*a*, and thus a sound pressure in a low register may be tuned. Since the air module body 200*a* and the duct body 203*a* have a ring shape, the length of the duct 230*a* may vary depending on an angle occupied by the duct body 203*a* at 360°, which is the angle of the entire air module body 200*a*.

The duct body 203*a* may not be separately manufactured but may be integrally manufactured when the air module body 200*a* is manufactured. However, when the duct body 203*a* is separately manufactured, sound characteristics of the receiver module may be advantageously tuned by changing only the length of the duct body 203*a* coupled to the air module body 200*a*.

Figure 10:
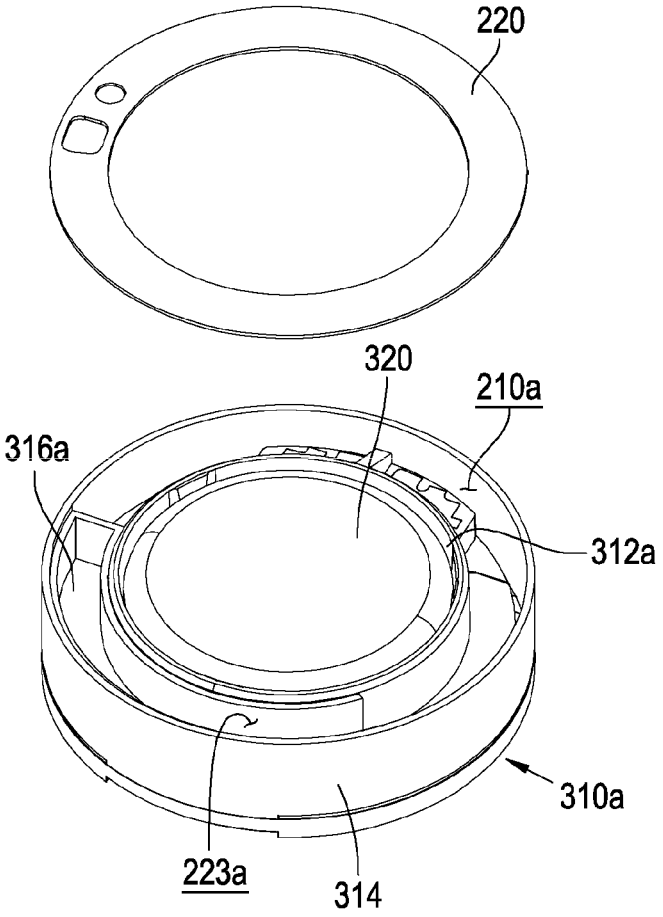
FIG. 10 is an exploded view of a receiver module integrated with a duct according to a third embodiment of the present disclosure.
Figure 11:
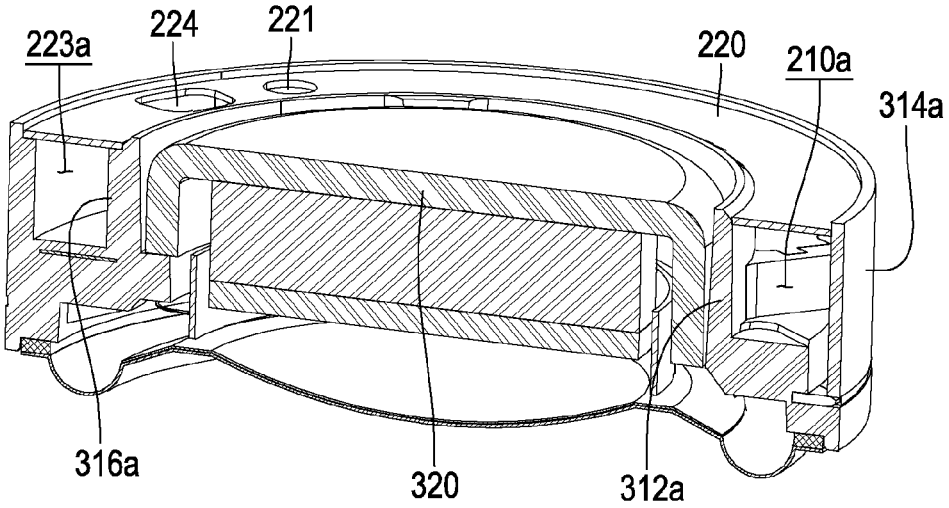
FIG. 11 is a cross-sectional view of a receiver module integrated with a duct according to the third embodiment of the present disclosure.

FIG. 10 is an exploded view of a receiver module integrated with a duct according to a third embodiment of the present disclosure, and FIG. 11 is a cross-sectional view of a receiver module integrated with a duct according to the third embodiment of the present disclosure.

In the receiver module integrated with a duct according to the third embodiment of the present disclosure, the air module body in the first and second embodiments is formed integrally with the frame.

In the receiver module integrated with a duct according to the third embodiment of the present disclosure, a frame 310*a* of a receiver includes an inner wall 312*a* surrounding a yoke 320 and an outer wall 314*a* spaced apart from the yoke 320, and a space between the inner wall 312*a* and the outer wall 314 is used as the back volume 210*a*. In the back volume 210*a*, a partition 316*a* for defining the duct 223*a* is provided as in the previous embodiments. A length of the duct 223*a* varies according to a length of the partition 316*a*, the sound characteristics of the receiver module also vary.

The plate 220, whose inner circumference and outer circumference are respectively coupled to the inner wall 312*a* and the outer wall 314*a* of the frame 310*a*, and which defines the back volume 210*a* and the duct 223*a* together with the frame 310*a* is provided. The plate 220 is the same as the plate in the first embodiment. The plate 220 includes a back volume communication hole 221 in communication with the back volume 210*a* and a duct communication hole 224 in communication with the duct 223*a*.

Figure 12:
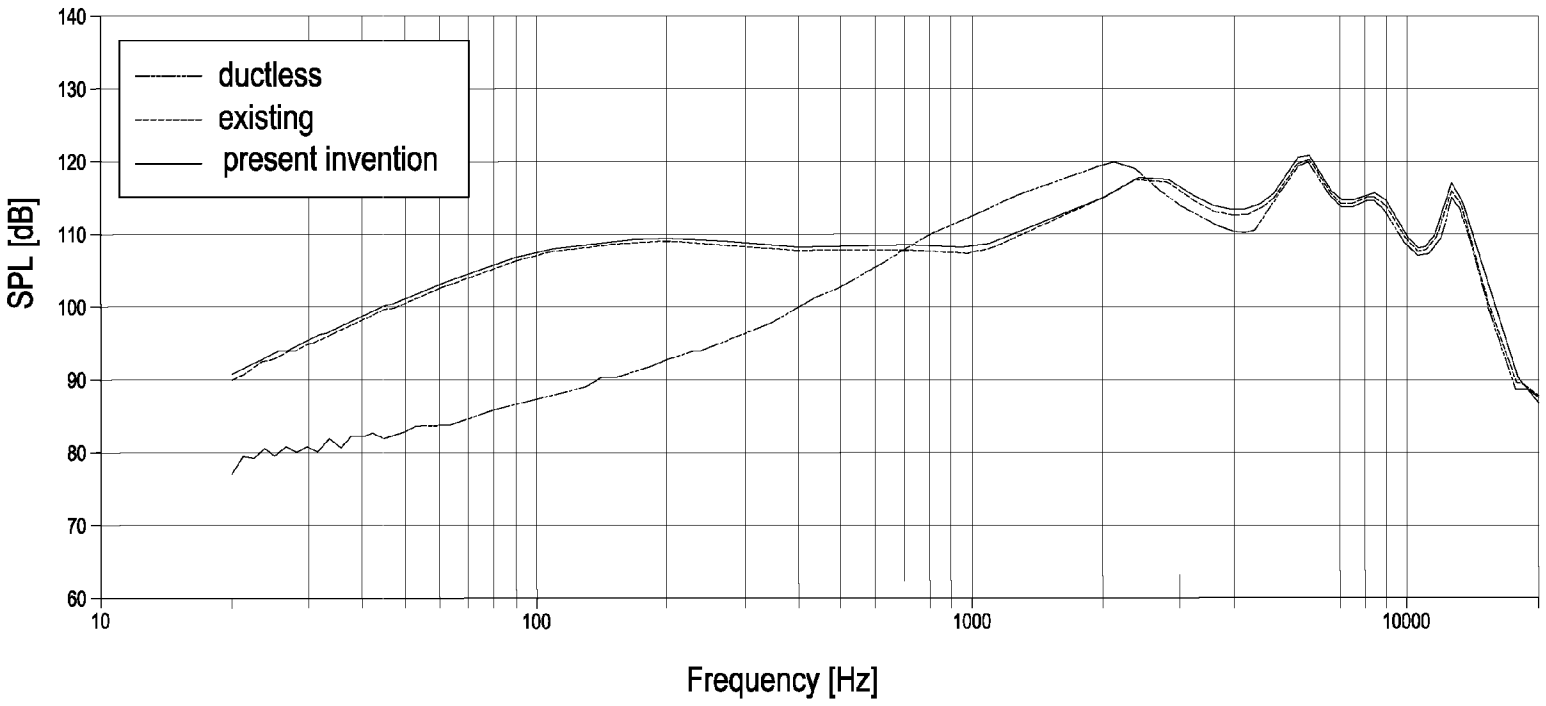
FIG. 12 is a graph showing a comparison between sound pressure by frequency of an earphone to which a receiver module integrated with a duct according to an embodiment of the present disclosure is applied, a duct-divided earphone of the related art, and a ductless earphone.

FIG. 12 is a graph showing a comparison between sound pressure by frequency of an earphone to which a receiver module integrated with a duct according to an embodiment of the present disclosure is applied, a duct-divided (existing) earphone of the related art, and a ductless earphone.

As can be seen from the graph, compared to an earphone without a duct, when a duct is formed, the sound pressure in the low frequency band may be improved to achieve flattening of overall sound. It can be seen that the effect of improving the low-frequency characteristics is the same without a significant difference between when a separate bracket is provided and installed in the rear housing (duct-divided, existing) as in the related art and when the module is formed integrally with the receiver as in the present disclosure.

Therefore, since the back volume and the duct are disposed within the overall height of the receiver, while obtaining the same effect of improving the sound pressure in the low register, the receiver module including the back volume and the duct may be placed in the earphone housing and space utilization of the rear surface of the receiver module may be increased.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A receiver module integrated with a duct, the receiver module comprising:

a receiver including a magnetic circuit, a frame covering the magnetic circuit, a voice coil, and a diaphragm and having a back hole for ventilation on the frame;

a back volume communicating with the back hole of the receiver and an outside and amplifying sound through resonance; and a duct provided in the back volume and having a communication hole communicating with the outside separately from the back volume, wherein the back volume is disposed on an outer circumference of the receiver, wherein the back volume is defined by an air module body coupled to an outer circumference of the frame, the frame, and a plate bonded to a lower surface of the air module body.

2. The receiver module of claim 1, wherein the back volume has a size not exceeding an overall height of the receiver.

3. The receiver module of claim 1, wherein the air module body comprises a partition forming a duct.

4. A receiver module integrated with a duct, the receiver module comprising:

a receiver including a magnetic circuit, a frame covering the magnetic circuit, a voice coil, and a diaphragm and having a back hole for ventilation on the frame;

a back volume communicating with the back hole of the receiver and an outside and amplifying sound through resonance;

a duct provided in the back volume and having a communication hole communicating with the outside separately from the back volume;

an air module body having a lower surface coupled to an inner circumference of the frame and a side surface coupled to an outer circumference of the frame and defining the back volume with the frame; and a duct body coupled within the air module body and defining the duct.

5. The receiver module of claim 4, wherein the lower surface of the air module body comprises a back volume communication hole communicating with the back volume and a duct communication hole communicating with the duct.

6. A receiver module integrated with a duct, the receiver module comprising:

a receiver including a magnetic circuit, a frame covering the magnetic circuit, a voice coil, and a diaphragm, and having a back hole provided at the frame for ventilation;

a back volume communicating with the back hole of the receiver and an outside and amplifying sound through resonance; and a duct provided in the back volume and having a communication hole communicating with the outside separately from the back volume, wherein the back volume is provided in the frame, wherein the frame of the receiver has an inner wall coupled to a yoke, an outer wall formed to be spaced apart from the inner wall, and a duct forming partition traversing the inner wall and the outer wall, wherein the receiver module further comprises a plate coupled to the inner wall and the outer wall of the frame and having a back volume communication hole and a duct communication hole.

7. The receiver module of claim 6, wherein the back volume has a size not exceeding an overall height of the receiver.

8. The receiver module of claim 6, wherein the back volume has a size not exceeding an overall height of the receiver.

9. A receiver module integrated with a duct, the receiver module comprising:

a receiver including a magnetic circuit, a frame covering the magnetic circuit, a voice coil, and a diaphragm, and having a back hole provided at the frame for ventilation;

a back volume communicating with the back hole of the receiver and an outside and amplifying sound through resonance; and a duct provided in the back volume and having a communication hole communicating with the outside separately from the back volume, wherein the back volume is disposed within an overall height of the receiver, wherein a rear space of the receiver which is opposite to the diaphragm is utilized as an installation space of a PCB (printed circuit board) or related hardware of the PCB.

10. The receiver module of claim 9, wherein the back volume is defined by an air module body coupled to an outer circumference of the frame, the frame, and a plate bonded to a lower surface of the air module body.

11. The receiver module of claim 10, wherein the air module body comprises a partition forming a duct.

12. The receiver module of claim 9, further comprising:

an air module body having a lower surface coupled to an inner circumference of the frame and a side surface coupled to an outer circumference of the frame and defining a back volume with the frame; and a duct body coupled within the air module body and defining the duct.

13. The receiver module of claim 12, wherein the lower surface of the air module body comprises a back volume communication hole communicating with the back volume and a duct communication hole communicating with the duct.

14. The receiver module of claim 9, wherein the frame of the receiver has an inner wall coupled to a yoke, an outer wall formed to be spaced apart from the inner wall, and a duct forming partition traversing the inner wall and the outer wall, and wherein the receiver module further comprises:

a plate coupled to the inner wall and the outer wall of the frame and having a back volume communication hole and a duct communication hole.

* * * * *